United States Patent [19]

Mimura et al.

[11] Patent Number: 4,604,337

[45] Date of Patent: Aug. 5, 1986

[54] ELECTROPHOTOGRAPHIC COLOR COPYING PAPER AND COPYING METHOD MAKING USE OF THE SAME

[75] Inventors: Yoshiyuki Mimura; Akitoshi Toda, both of Hachioji, Japan

[73] Assignee: Olympus Optical Co., Ltd., Tokyo, Japan

[21] Appl. No.: 675,785

[22] Filed: Nov. 28, 1984

[30] Foreign Application Priority Data

Nov. 28, 1983 [JP] Japan ..... 58-222096
Nov. 28, 1983 [JP] Japan ..... 58-222097

[51] Int. Cl.[4] ..... G03G 5/12
[52] U.S. Cl. ..... 430/46; 430/42
[58] Field of Search ..... 430/42, 46, 228

[56] References Cited

U.S. PATENT DOCUMENTS 3,898,082 8/1975 Giaimo ..... 430/42
4,291,109 9/1981 Whitmore ..... 430/146
4,439,504 3/1984 Ishihara et al. ..... 430/42

*Primary Examiner*—John L. Goodrow
*Attorney, Agent, or Firm*—Armstrong, Nikaido, Marmelstein & Kubovcik

[57] ABSTRACT

An electrophotographic color copying paper has a transparent substrate layer, a color filter layer formed on one side of the transparent substrate layer, and a transparent photosensitive layer formed on the other side of the transparent substrate layer. Using this copying paper, an electrophotographic color copy is obtained by a method having the steps of effecting a uniform charging on the side of the copying paper carrying the transparent photosensitive layer, effecting a color light image exposure from the side of the copying paper carrying the color filter so as to form an electrostatic latent image on the transparent photosensitive layer, and developing the electrostatic latent image on the transparent photosensitive layer by a black toner.

22 Claims, 9 Drawing Figures

ELECTROPHOTOGRAPHIC COLOR COPYING PAPER AND COPYING METHOD MAKING USE OF THE SAME

BACKGROUND OF THE INVENTION

The present invention relates to an electrophotographic color copying paper and a copying method making use of this copying paper.

A typical conventional electrophotographic color copying technique employs a photosensitive device provided with a photoconductive layer which has a panchromatic photosensitivity. In the use of this photosensitive device, a color copy is produced by a process which includes four repetitional operations each having, after a uniform charging, a color light image exposure (B,G,R,Blk) through a color separation filter to obtain a latent image which is then devloped by a toner (yellow, cyanide, magenta, black) of each of colors corresponding to the colors of the color separation filter.

This conventional method, however, requires a complicated and time-consuming process and, in addition, the cost of the copying apparatus is raised and the size of the apparatus is increased impractically due to the necessity for the four developing units for different toner colors which occupy a large space.

To obviate this problem, Japanese Patent Publication No. 36019/1977 discloses a color copying paper having a conductive layer, a photoconductive layer on the conductive layer, and a color mosaic filter layer on the photoconductive layer. The color mosaic filter serves also as an insulating layer. In the use of this color copying paper, a color light image exposure is effected by an image-forming process employing a step in which a charging and a light image exposure are conducted simultaneously so as to form an electrostatic latent image on the color mosaic filter layer. This latent image is then developed by toners thus producing a color copy.

This color copying paper is superior in that it can produce a color copy by a single light image exposure, but still suffers from the following problems. Namely, since the color mosaic filter layer is formed in direct contact with the photosensitive layer, the property of the photoconductive layer is liable to be impaired during the production. In addition, since the color mosaic filter layer itself has to be charged, the filter layer itself has to be electrically insulating, which undesirably limits the material of the filter layer and the method of mixing of color elements. In order to form a sufficiently strong latent image on the filter layer, it is necesary to strictly control the thickness of this layer. For instance, an optical dimming of the copy image will be caused if the filter layer is made too thick.

For obtaining a sufficiently strong latent image, it is necessary to apply a high voltage to the color copying paper. A too high voltage, however, may cause a breakdown of the mosaic filter layer. It is to be noted also that a high voltage applied to the copying paper may cause a fading of colors in the color mosaic filter due to an ozone oxidation caused by a corona charging, resulting in a change in the color absorption characteristics to adversely affect the quality of the copy. For these reasons, it is not allowed to apply a sufficiently high voltage.

When a simpler image-forming process known as "Carlson Process" is used, the color mosaic filter layer serves as a barrier layer, so that electric charge is allowed to remain in the bright portion of the electrostatic latent image to cause a fog. The Carlson process, therefore, cannot be applied practically. It is, therefore, necessary to use the image-forming process having a step in which the charging and the light image exposure are conducted simultaneously, requiring a greater number of chargers.

In addition, since the toner is deposited to the color mosaic filter layer itself and fixed to the same by heat or pressure, the property of the filter is impaired in this fixing step to adversely affect the quality of the copy image.

It is to be noted also that a complicated process is required for the production of the color mosaic filter layer so that the cost of this layer is considerably high. Namely, in order that the mosaic filter layer has an insulating power suitable for serving as a part of the photosensitive device, and in order to avoid the undesirable dimming of the copy image, the thickness of this layer has to be controlled strictly to range between 20 and 80$\mu$. When the filter layer is made of a plastic, the thickness control is conducted through a number of steps including heating of the plastic up to a temperature above the room temperature and rolling the same to reduce the thickness, resulting in a rise of the production cost. This problem is serious particularly when the color copying paper is intended for use as expendable supplies as, for example, copying paper for CPC (Coated paper Copier).

SUMMARY OF THE INVENTION

Accordingly, an object of the invention is to provide an electrophotographic color copying paper which can be produced by a simple process at a reduced cost and which affords a high clarity of the copy image through a single process including the steps of charging, light image exposure and development.

Another object of the invention is to provide an electrophotographic color copying method which can ensure a high clarity of the copy image by a single cycle of process including the steps of charging, light image exposure and development, and which does not impose any limitation of the material of the filter layer nor cause any deterioration in the property of the filter layer.

To this end, according to one aspect of the invention, there is provided an electrophotographic copying paper comprising: a transparent substrate layer; a color filter layer provided on one side of the transparent substrate, and a photosensitive layer provided on the other side of the transparent substrate.

According to another aspect of the invention, there is provided a method of conducting a color copying by using an electrophotographic color copying paper having a color filter layer provided on one side of a transparent substrate and a transparent photosensitive layer formed on the other side of the transparent substrate, the method comprising the steps of: effecting a uniform charging on the side of the copying paper carrying the transparent photosensitive layer; effecting a color light image exposure from the side of the copying paper carrying the color filter layer thereby forming an electrostatic latent image on the transparent photosensitive layer; and developing the electrostatic latent image on the transparent photosensitive layer by a black toner thus producing a color copy.

The color copying paper of the invention having the above-described features can be produced easly and ensures a high quality of the copy image. In addition, a simple image-forming process such as Carlson process can be applied to this copying paper.

At the same time, the color copying method of the invention having the above-described features provides a high clarity of the copy image by a single process having the steps of charging, light image exposure and development, without being accompanied by problems such as the limitation of the filter layer material and the degradation of the color characteristics of the filter layer.

BRIEF DESCRIPTION OF THE DRAWINGS

FIGS. 5A to 5E are illustrations of steps in a color copying method in accordance with the invention in which:

FIG. 5A illustrates a step of uniform charging;

FIG. 5B shows a step of color light image exposure;

FIG. 5C shows a step of development by toner;

FIG. 5D shows a step of fixing of image; and

FIG. 5E shows a step of laminating of layers.

DESCRIPTION OF THE PREFERRED EMBODIMENTS

Preferred embodiments of the invention will be described hereinunder. Basically, the electrohotographic color copying paper in accordance with the invention has a transparent substrate layer on one side of which is provided a color filter composed of three colors while the other side of the substrate layer is provided with a transparent photosensitive layer.

Figure 1:
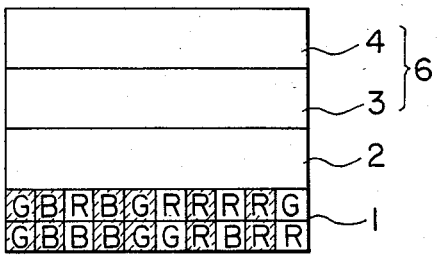
FIG. 1 is a schematic sectional view of an embodiment of an electrophotographic color copying paper in accordance with the invention.
Figure 2:
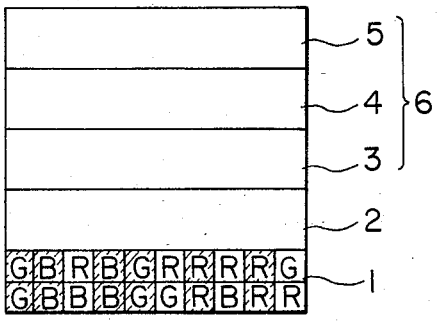
FIGS. 2 and 3 are schematic sectional view of different embodiments.
Figure 3:
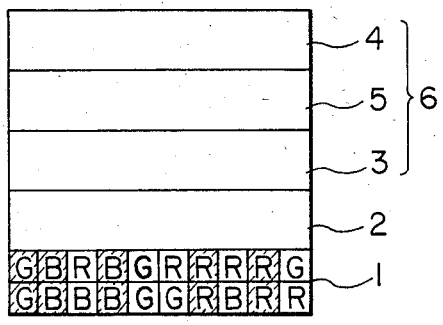
Figure 4:
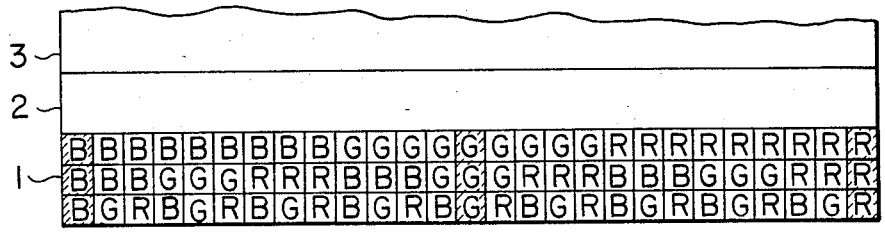
FIG. 4 is a schematic illustration of a color random filter layer composed by laminating three layers of the photoelectric color copying paper in accordance with the invention.

FIGS. 1 to 3 are schematic sectional views of different embodiments of the color copying machine in accordance with the invention. More specifically, the color copying paper shown in FIG. 1 has a transparent substrate layer 2 on one side of which is provided a color random filter layer 1 while the other side of the substrate layer is provided with a photosensitive layer 6 which is composed of a transparent conductive layer 3 and a transparent photoconductive layer 4. The color copying paper shown in FIG. 2 has a transparent insulating layer 5 formed on the transparent photoconductive layer 4 of the copying paper shown in FIG. 1. Thus, in this case, the photosensitive layer 6 is composed of three layers. The color copying paper shown in FIG. 3 has a transparent insulating layer 5 interposed between the transparent conductive layer 3 and the transparent photoconductive layer 4. Thus, the photosensitive layer 6 is composed of three layers also in this case.

Resin films such as of polyamide, polyester, acetylcellulose, polyvinyl alcohol, butyral, hidroxiethyl, methylmethacrylate and the like are usable as the material of the transparent substrate layer 2.

The transparent conductive layer 3 is constituted by an evaporated film of $In_2O_3$, $SnO_2$, ITO, CuI, $TiO_2$, Pd, $Cd_2SnO_4$ and so forth. Alternatively, the transparent conductive layer is formed of a mixture of one of the above-mentioned materials with a suitable transparent binder.

Practically, the transparent photoconductive layer 4 is formed of a material such as polyvinylcarbazole (PVK) and oxidiasole, to which is added an additive for increasing the color sensitivity such as P-chloranil, P-benzoquinone, trinitro fluorenone (TNF), brilliant green or the like. The thickness of this layer optimumly ranges between 10 and 50$\mu$.

The color random filter layer 1 provided on one side of the transparent substrate layer 2 in each embodiment can be produced by a process which is simpler than those for the production of conventional color mosaic filter and color stripe filter at a reduced cost as compared with these known filters, while ensuring a constant quality of the color image. More practically, this color random filter layer is produced in accordance with the following procedures.

According to one of these procedures, the color materials are micro-capsulated and a ternary vacuum evaporation is conducted by employing three resistance heating units or three electron-beam heating units, thereby forming the color random filter layer. According to another procedure, the micro-capsulated color materials are applied through the aid of a suitable transparent binder to form the random filter layer.

Either of these procedures is quite simpe because the filter can be formed in a random-color manner. In the formation of the color random filter layer, however, attention must be drawn to the following fact. In case of a regular filter, the ratios of the light transmission of respective colors are determined by the number of the unit filter material. In a random filter, however, assuming that the filter layer has a laminated structure composed of n layers, the ratios of the light transmission are reduced to $(\frac{1}{3})^n$, in the case where three colors B,G and R are employed. Assuming here also that the particle size of the unit filter color material is about 1$\mu$, when three layers are laminated, the resolving power is calculated to be $3^3=27$ $\mu$, i.e., about 40 stripes per millimeter for single color and 12 stripes per millimeter for three colors. For attaining good resolving power and gradation, the number n of layers to be laminated should be not greater than 3, preferably 1 or 2.

Thus, the preparation of the filter layer in the form of a random layer requires the number n of laminated layers to be 3 or smaller. Generally, however, it is quite difficult to control the number of layers of the particles having extremely small particle sizes. According to the invention, therefore, the unit filter color materials are micro-capsulated to simultaneously effect both the granulation and the control of the particle size to a range of between 0.3 and 5 $\mu$, so that a color random filter having an excellent color resolving power can be obtained.

For the micro-capsulation of the filter color materials which are usally dyestuffs or pigments, various methods can be employed such as a coacervation process which is a chemical method, an interfacial polymerization method, phase-separation from an aqueous solution system, phase-separation from organic solvent and so forth.

Examples of filter color materials suitably used in the invention are as follows:

Blue color:

direct azurine G direct fast blue 2GL cyan anthrol R
indigo pure
threne blue RSN
disperse blue
oil blue G extra
procion brilliant blue R
disperse fast brilliant blue B
phthalocyanine blue
vat blue 6
victoria pure blue lake Green color:
chlorantine fast green FGLL
threne brilliant green BFFB
disperse green 3B
rapidgen green B
malachite green
wool fast green B
phthalocyanine green
pigment green B
green gold Red color:
benzopurprine 4B
acid fast red 3G
acid azo rubine
rapid fast red CZH
threne red GG
disperse scarlet B
chiba acron brilliant red 8B
permanent red R
vulcan fast red GF
watchung red Mn
lake red C.

A description will be made hereinunder as to a practical method for forming a random color filter layer by ternary vacuum evaporation process from micro-capsulated color materials.

For instance, crystals of phthalocyanine capsulated into particle size of several microns ($\mu$) are used as the blue color material, while micro-capsulated carbocyanineiodide is used as the green color material. Finally, microcapsulated erythrosine is used as the red color material. These capsulated color materials are vacuum evaporated by electric resistance heating. Preferably, the vacuum evaporation is conducted by flush-type method in which the micro-capsulated color materials supplied from the outside are scattered instantaneously. The micro-capsulated color materials then fly in the form of a cluster which form a cluster-like deposit on the transparent substrate thus providing a three-color random filter having an excellent color selectivity.

The color random filter layer may be formed by using a transparent binder in accordance with the following process. In this case, the color materials of three colors are mixed in such a way as to meet the requirement concerning the optical characteristics and are dispersed by means of cellulose, polyamide, polyester, polystylene, vinyl, polyethylene, acryl, polypropylene and the like, and the dispersion is applied to the transparent substrate by a roll coater method, knife coater method, dipping method, screen printing method or other known method, followed by a drying thus completing the formation of the three-color random filter layer.

In advance of the formation of the color random filter layer on the transparent substrate, the aforementioned transparent photoconductive layer of $In_2O_3$, $SnO_2$, $Cd_2SnO_4$ or the like is formed beforehand on the other side of this transparent substrate. The color copying paper as shown in FIG. 1 is completed by forming a transparent photoconductive layer on this transparent conductive layer.

The color copying papers shown in FIGS. 2 or 3 can be produced by providing the transparent insulating layer on the transparent photoconductive layer or between the transparent conductive layer and the transparent photoconductive layer.

The color copying paper thus produced can be used suitably in a color copying method embodying the present invention as will be explained hereinunder.

When the color copying paper shown in FIG. 1 is used, the copying is conducted as follows.

Figure 5A:
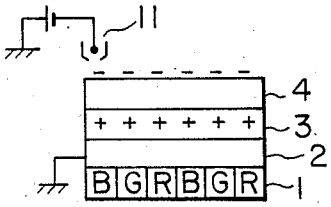
Figure 5B:
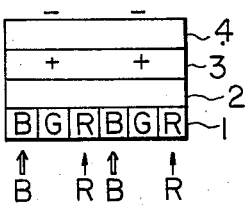
Figure 5C:
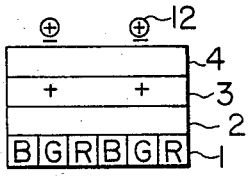

In a first step, the transparent photoconductive layer 4 is charged uniformly in the darkness through a corona discharge effected by a charger 11, as shown in FIG. 5A. Then, in a second step, an exposure to the color light image of the color original is conducted from the same side as the color random filter layer 1 of the copying paper as shown in FIG. 5B so that a color electrostatic latent image is formed on the transparent photoconductive layer 4. In a subsequent third step, this color latent image is developed by a black toner 12 as shown in FIG. 5C. In the final step shown in FIG. 5D, this toner image is fixed by a fixing device 13 of heating type or pressing type, thus completing the color copying. The development and the fixing can be effected simultaneously if a pressure-fixing type toner is used.

The color copy obtained through the above-explained copying method can be observed as it is as a transmission-type color copy. For attaining a higher visibility of the color copy image, however, the method may be modified to a reflection type method to produce a color copy which can be observed in the same way as the ordinary color copy. To this end, as shown in FIG. 5E, a reflector 14 containing fine particles of $Al_2O_3$, MgO, $TiO_2$, ZnS and ZnO or, alternatively, a reflector 14 having an evaporated film of Al,Ag or the like is laminated to the transparent photoconductive layer 4 by means of an adhesive, so that a reflection type color copy can be obtained. In this case, it is possible to protect the filter material against any deterioration by laminating a transparent protective film 15 of, for example, polyethylene terephthalate to the random filter layer 1 as shown in this Figure.

When the copying paper shown in FIG. 2 or 3 is used, basically, one of the following three methods (1) to (3) is used as the method for forming the electrostatic latent image, followed by the same process as that taken after the formation of the electrostatic latent image in the described embodiment of the copying method.

(1) a method having:

a first step of effecting a D.C. corona charging;

a second step of effecting a corona charging in the reverse polarity to that of the D.C. charging in the first step or an A.C. corona charging simultaneously with a light image exposure; and a third step of effecting an exposure of whole area (referred to as "whole exposure")

(2) a method having:

a first step of effecting a D.C. corona charging simultaneously with a light image exposure;

a second step of effecting a corona charging in the polarity reverse to that of the D.C. charging in the first step; and a third step of effectng a whole exposure.

(3) a method having:

a first step of effecting a D.C. corona charging;

a second step of effecting a corona charging in the polarity reverse to that of the D.C. charging in the first step; and a third step of effecting a light image exposure.

Figure 5D:
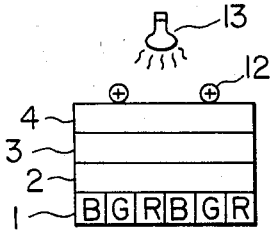
Figure 5E:
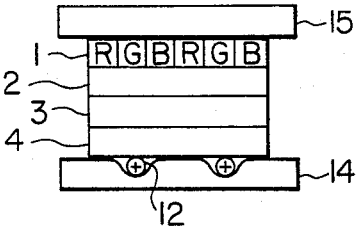

When it is desired to use the color copying papers of the described embodiments repeatedly, the fixing of the toner image conducted in the fixing step shown in FIG. 5D is made in a somewhat weak manner or the fixing step is completely omitted. Then, after observation of the color copy, the surface of the transparent photoconductive layer 4 is cleaned by means of, for example, a brush and electrostatic charges are removed therefrom. After the removal of the charges, the color copying paper is ready for the next copying operation so that a new color copy is formed on the copying paper by conducting the same copying process as that described hereinbefore.

A more detailed description will be made hereinunder as to the method of producing the color copying paper of the invention, as well as the practical example of the color copying method conducted with the produced color copying paper.

Referring first to the method of producing the color copying paper, the micro-capsules for forming the color random filter layer are prepared in accordance with the following method.

In this case, a blue color material "disperse fast brilliant B" is used as the core material. This material is emulsified and dispersed in an aqueous solution of gelatin of 40° C. containing an activating agent. In this state, the emulsification and dispersion are conducted by a light scattering method until a mean particle size of 0.5μ is obtained. The thus obtained emulsion is then dispersed in an aqueous solution of gum arabic and the pH value is adjusted by an aqueous solution of acetic acid to a level below the isoelectric point of gelatin, so that a coacervation is effected to form a coacervate layer constituted by gelatin and gum arabic, thus completing the basic form of the micro-capsule.

Then, after lowering the temperature down to 20° C. and adding liquid formalin, the pH value is adjusted to 8.5 by supplying $Na_2CO_3$ thereby solidifying gelatin to make the same insoluble in water. Then, the micro-capsule dispersion is centrifugated and dries to form micro-capsules of a mean particle size of about 1.5μ.

A "threne brilliant green BFFB" as the green color material and a "disperse scarlet B" as the red color material are micro-capsulated into particle size of about 1.5μ by the same process as that described above.

Then, the thus obtained microcapsules of three colors are mixed at an equal ratio and the mixture is applied, through the aid of polyester resin as a binder, to one side of a polyethylene terephthalate film by screen printing method, the polyethylene terephthalate film being provided beforehand with an ITO transparent conductive layer formed on the other side thereof by electron-beam evaporation method. Consequently, a color random filter layer of about 2μ is formed. Then, a layer of PVK transparent photoconductive layer doped with $2\times10^{-5}$ mol of TNF per 1 g of PVK is formed on the ITO conductive layer by means of a doctor blade to a thickness of 20μ, thus completing the color copying paper.

A corona charging was effected at a voltage of −6 KV on the color copying paper thus obtained from the same side as the transparent photoconductive layer, followed by a color image exposure from the same side as the color random filter. As a result, an electrostatic latent image having a maximum contrast potential of −350V was obtained. This latent image was developed by a P toner and fixed, and a reflector containing MgO was laminated to the transparent photoconductive layer, thus attaining a color copy of an excellent quality. In another test, the fixing after the development was omitted and toner was removed by a cleaning brush from the color copying paper. After the removal of the electrostatic charge, the copying paper was subjected again to a color copying operation. Consequently, an excellent quality of color copy equivalent to the first copy was confirmed.

In the foregoing embodiments of the color copying paper of the invention, the color filter layer is constituted by a random filter layer which is easy to produce. The color filter layer in the color copying paper of the invention, however, may be constituted by other type of filter layer such as a stripe filter layer. The color copying method of the invention described hereinbefore can equally apply to the color copying paper having a color filter layer constituted by a filter layer other than the random filter layer.

A description will be made hereinunder as to a practical example of the method of producing a color copying paper having a color stripe filter layer.

As the first step, a film of polyethylene terephthalate having a thickness of 38μ is prepared, and ITO is deposited to one side of the film by an electron-beam evaporation method. Then, a color stripe filter layer is formed on the other side of the film. This color stripe filter layer is formed using copper phtharocyanine as the blue color material, carboxyanioniodide as the green color material and eosine as the red color material, through three cycles of vacuum evaporation employing different masks which permit deposition of only one of the colors, under a vacuum of $10^{-5}$ Torr. Then, a PVK transparent photoconductive layer, doped with $2\times10^{-5}$ mol of P-chloranil per 1 g of PVK, is applied by a spraying method to form a layer of 20μ on the ITO conductive film formed on one side of the polyethylene terephthalate film.

As in the case of the color copying method explained before, the thus produced color copying paper was subjected to a corona charging at a voltage of −6.5 KV and the color image exposure was conducted from the same side as the stripe filter layer. As a result, an electrostatic latent image having a maximum potential of −350 V was obtained. This latent image was developed by a P toner and was fixed by pressure. Thereafter, a reflector and a transparent polyethylene terephthalate film were laminated, respectively, to the transparent photoconductive layer and the stripe filter layer. The color copy thus produced showed a high quality with a superior gradation. It was confirmed also that the filter is not deteriorated even when subjected to external light so that the color copy can maintain its initial quality for a long time.

It will be clear to those skilled in the art that the stripe filter layer used as the color filter layer in this embodiment can be used equally also in a color copying paper of the type having a transparent insulating layer.

As will be understood from the foregoing description, according to the invention, a color copying paper is formed by a color filter layer and a photosensitive layer which are attached to both sides of a transparent substrate. In use, a corona charging is effected on the side of the color copying paper carrying the photosensitive layer, while a light image exposure is conducted from the side of the color copying paper carrying the color filter layer, so as to form a toner image on the side of the paper carrying the photosensitive layer thus producing a color copy.

Therefore, the material of the color filter layer can be determined without taking into account the electric insulating power of the material. This in turn allows the use of a color filter material having suitable optical characteristics and mechanical strength. In addition, since the toner does not directly attach to the color filter layer, the degradation of the color filter in the fixing step is avoided to ensure a high quality of the color image. In addition, the color copying paper of the invention can undergo a repeated use if the fixing is omitted and a suitable means is employed for the removal of the toner after development.

The color copying paper of the invention, having the color filter layer and the photosensitive layer on opposite sides of the transparent substrate, can be produced by a process which is simpler and more easy to conduct than the production of the color copying paper disclosed in Japanese Patent Publication No. 36019/1977 mentioned before. In this copying paper, since the filter layer and the photosensitive layer are separated from each other by the transparent substrate, the filter layer produces only an optical effect but no electrical effect during the formation of the electrostatic latent image. This means that the residual potential produced by the electric resistance across the filter layer does not matter substantially. Therefore, in one form of the invention having no transparent insulating layer, it is possible to form the electrostatic latent image by the Carlson type method which is rather easy to carry out.

It is to be noted also that a remarkable improvement in the production efficiency can be attained by the use of a color random filter as the color filter layer. In this case, CPC color papers of low price can be produced so that the cost of color copy production can be reduced remarkably.

Furthermore, it is possible to obtain a color copy of a good qality which can be observed easily almost equally to ordinary photographic color print, by laminating a reflector on the transparent photosensitive layer of the copying paper after the development and fixing. It is also possible to avoid any unfavourable optical effect on the color filter layer during copying and to maintain the quality of the copy image for a long time through elimination of deterioration caused by external light, by providing a transparent protective layer on the color filter layer after the development and fixing.

What is claimed is:

1. An electrophotographic copying paper comprising an integrated structure having: a transparent substrate layer; a color filter layer provided on one side of said transparent substrate layer, and a photosensitive layer provided on the other side of said transparent substrate layer, said photosensitive layer including a transparent conductive layer so that said photosensitive layer can function as a photoconductive layer.

2. An electrophotographic copying paper according to claim 1, wherein said color filter layer is constituted by a color random filter layer.

3. An electrophotographic copying paper according to claim 1, wherein said transparent photosensitive layer is composed of said transparent conductive layer and a transparent photoconductive layer which are formed successively on said transparent substrate layer.

4. An electrophotographic copying paper according to claim 2, wherein said transparent photosensitive layer is composed of said transparent conductive layer and a transparent photoconductive layer which are formed successively on said transparent substrate layer.

5. An electrophotographic copying paper according to claim 1, wherein said transparent photosensitive layer is composed of said transparent conductive layer, a transparent photoconductive layer, and a transparent insulating layer which are formed successively on said transparent substrate layer.

6. An electrophotographic copying paper according to claim 2, wherein said transparent photosensitive layer is composed of said transparent conductive layer, a transparent photoconductive layer, and a transparent insulating layer which are formed successively on said transparent substrate layer.

7. An electrophotographic copying paper according to claim 1, wherein said transparent photosensitive layer is composed of said transparent conductive layer, a transparent insulating layer, and a transparent photoconductive layer which are formed successively on said transparent substrate layer.

8. An electrophotographic copying paper according to claim 2, wherein said transparent photosensitive layer is composed of said transparent conductive layer, a transparent insulating layer, and a transparent photoconductive layer which are formed successively on said transparent substrate layer.

9. An electrophotographic copying paper according to claim 2, wherein said color random filter layer is composed of micro-capsules of blue, green and red color materials, and has a thickness which is not greater than a size three times as large as the particle size of said capsules.

10. An electrophotographic copying paper according to claim 4, wherein said color random filter layer is composed of micro-capsules of blue, green and red color materials, and has a thickness which is not greater than a size three times as large as the particle size of said capsules.

11. An electrophotographic copying paper according to claim 6, wherein said color random filter layer is composed of micro-capsules of blue, green and red color materials, and has a thickness which is not greater than a size three times as large as the particle size of said capsules.

12. An electrophotographic copying paper according to claim 8, wherein said color random filter layer is composed of micro-capsules of blue, green and red color materials, and has a thickness which is not greater than a size three times as large as the particle size of said capsules.

13. An electrophotographic color copying method using an electrophotographic color copying paper of an integrated structure having a filter layer provided on one side of a transparent substrate layer and a transparent photosensitive layer formed on the other side of said transparent substrate layer, said photosensitive layer including a transparent conductive layer so that said photosensitive layer can function as a photoconductive layer; said method comprising the steps of: effecting a uniform charging on the side of said copying paper carrying said transparent photosensitive layer; effecting a color light image exposure from the side of said copying paper carrying said color filter layer thereby forming an electrostatic latent image on said transparent photosensitive layer; and developing said electrostatic latent image on said transparent photosensitive layer by a black toner thus producing a color copy.

14. An electrophotographic color copying method according to claim 13, wherein said color filter layer of said electrophotographic copying paper is constituted by a color random filter layer.

15. An electrophotographic color copying method according to claim 13, further comprising the step of fixing the toner image after the development.

16. An electrophotographic color copying method according to claim 14, further comprising the step of fixing the toner image after the development.

17. An electrophotographic color copying method according to claim 15, further comprising the step of laminating a reflector on the surface of said transparent photosensitive layer after the fixing of the toner image.

18. An electrophotographic color copying method according to claim 16, further comprising the step of laminating a reflector on the surface of said transparent photosensitive layer after the fixing of the toner image.

19. An electrophotographic color copying method according to claim 17, further comprising the step of laminating a transparent protective layer on the surface of said filter layer after the fixing of said toner image.

20. An electrophotographic color copying method according to claim 18, further comprising the step of laminating a transparent protective layer on the surface of said filter layer after the fixing of said toner image.

21. An electrophotographic color copying method according to claim 13, further comprising the step of removing, after obtaining a color copy by the toner development, the toner image from said transparent photosensitive layer thereby permitting repeated use of said color copying paper.

22. An electrophotographic color copying method according to claim 14, further comprising the step of removing, after obtaining a color copy by the toner development, the toner image from said transparent photosensitive layer thereby permitting repeated use of said color copying paper.

* * * * *